US007896268B2

(12) United States Patent
Robinson et al.

(10) Patent No.: US 7,896,268 B2
(45) Date of Patent: Mar. 1, 2011

(54) APPARATUS FOR PRODUCING SMALL SIZE WOOD CHIPS

(75) Inventors: Mark Robinson, Black River, NY (US); Daniel R. McBride, Carthage, NY (US)

(73) Assignee: CEM Machine, Inc., Carthage, NY (US)

( * ) Notice: Subject to any disclaimer, the term of this patent is extended or adjusted under 35 U.S.C. 154(b) by 39 days.

(21) Appl. No.: 12/401,930

(22) Filed: Mar. 11, 2009

(65) Prior Publication Data

US 2010/0230523 A1 Sep. 16, 2010

(51) Int. Cl.
*B02C 19/00* (2006.01)

(52) U.S. Cl. ..... 241/55; 241/92; 241/152.2; 144/176

(58) Field of Classification Search ..... 144/176; 241/28, 55, 56, 92, 152.2
See application file for complete search history.

(56) References Cited

U.S. PATENT DOCUMENTS

| | | | | | |
|---|---|---|---|---|---|
| 2,388,799 | A | | 11/1945 | Payzer et al. | |
| 2,825,371 | A | * | 3/1958 | Forman | 144/41 |
| 3,032,281 | A | * | 5/1962 | Wexell | 241/92 |
| 3,410,495 | A | | 11/1968 | Eklund | |
| 3,635,410 | A | | 1/1972 | Smith | |
| 3,647,151 | A | * | 3/1972 | Artiano et al. | 241/92 |
| 4,155,384 | A | | 5/1979 | Svensson | |
| 4,198,887 | A | | 4/1980 | Williams, Jr. | |
| 4,346,744 | A | | 8/1982 | Beer et al. | |
| 4,503,893 | A | | 3/1985 | Demopoulos | |
| 4,850,408 | A | | 7/1989 | Carpenter et al. | |
| 4,977,939 | A | | 12/1990 | Depuy et al. | |
| 5,060,873 | A | | 10/1991 | Strong | |
| 5,102,056 | A | * | 4/1992 | Ober | 241/55 |
| 5,139,063 | A | | 8/1992 | Nettles et al. | |
| 5,293,917 | A | | 3/1994 | Kalliokoski | |
| 5,358,189 | A | * | 10/1994 | Vandermolen | 241/92 |
| 5,373,876 | A | | 12/1994 | Tähkänen et al. | |
| 5,390,865 | A | * | 2/1995 | Vandermolen et al. | 241/101.76 |
| 5,469,901 | A | | 11/1995 | Leguin | |
| 5,660,218 | A | | 8/1997 | Jonkka | |
| 5,873,397 | A | | 2/1999 | Lequin | |
| 6,196,284 | B1 | | 3/2001 | Lequin | |
| 6,484,770 | B1 | | 11/2002 | Jonkka | |
| 6,976,516 | B2 | | 12/2005 | Hale et al. | |
| 2004/0060616 | A1 | | 4/2004 | Jonkka et al. | |

(Continued)

FOREIGN PATENT DOCUMENTS

| | | |
|---|---|---|
| WO | WO 99/09242 | 2/1999 |

OTHER PUBLICATIONS

Earth Care Products Website; http://www.ecpisystems.com/wcms/index.php?burners; Jun. 17, 2008.

(Continued)

*Primary Examiner*—Mark Rosenbaum
(74) *Attorney, Agent, or Firm*—Hiscock & Barclay, LLP

(57) ABSTRACT

A disc type wood chipper that utilizes a high percentage of the energy required for chipping but not substantially utilized in the material size reduction within the machine to produce chips of a small enough size such that the chips produced can be turned into wood flour or wood pellets with the expenditure of very little additional energy.

15 Claims, 7 Drawing Sheets

U.S. PATENT DOCUMENTS

2006/0174973 A1 8/2006 Jonkka

OTHER PUBLICATIONS

Allegheny Pellet Corp. Website; http://www.woodpelletfuels.com/making.htm; Jun. 17, 2008.

New England Wood Pellet Website; http://www.pelletheat.com/core/aboutPellets/; Jun. 17, 2008.

Pellet Fuels Institute Website; http://www.pelletheat.org/3/news/facts.html; Jun. 17, 2008.

The Wider World of Pellet Fuel Website; http://www.pelletheat.orq/3/news/index/htm; Jun. 17, 2008.

* cited by examiner

APPARATUS FOR PRODUCING SMALL SIZE WOOD CHIPS

FIELD OF THE INVENTION

This invention involves a disc type wood chipper and, in particular, a wood chipping machine that is capable of producing wood chips of a small enough size such that the chips can be economically reduced to wood flour utilizing largely energy supplied to the machine for chipping but typically wasted in the chipping and chip discharge process.

BACKGROUND OF THE INVENTION

This invention relates to a wood chipping machine that utilizes most of the available and unused internal energy of the machine needed to generate chips of a size that they can be further reduced to wood flour in a single low energy cutting and hammering operation. This reduction to wood flour was historically accomplished by chipping logs or wood scraps into chips having a ¾" length/width or less and then collecting these chips and hammering them into wood flour in a high horsepower, energy inefficient hammer mill. Hammering whole logs and large chips directly into powder has also been attempted but has proven to be extremely inefficient and results in an extremely low production rate.

Typically disc type chippers having sufficiently large enough production rates suitable for use in economic industrial processes, utilize relatively large diameter discs which are generally in the 72" (1.8 M) range. Depending on the process involved, between 10 and 40 knives are used to obtain an adequate output rate when the disc is rotated at rim speeds of between 9,200 and 12,000 feet per minute (2800-3600 M/min). Accordingly, these machines require a good deal of energy, a high percentage of which is not consumed or utilized in the chipping process but is discharged from the machine with the chips largely in the form of heat.

SUMMARY OF THE INVENTION

It is therefore an object of the present invention to more thoroughly utilize virtually all of the energy supplied to a disc type wood chipper to further reduce the wood particle size normally produced in the chipper.

It is a further object of the present invention to improve large disc type chippers that are used in the production of wood flour.

It is a further object of the present invention to reduce the costs involved in the production of wood chips of a small size for chemical processing or for the production of pelletized fuels.

These and other objects of the present invention are attained in a disc type chipping machine having a chipping disc that contains a plurality of generally radially extending slots passing through the disc between its front face to its back face. The disc is enclosed within a protective casing. A primary knife is located within the front face entrance of each slot and is arranged to cut chips of a desired length from a wood work piece that is brought in contact therewith. A counter knife is mounted immediately behind each primary knife and is arranged to slice each chip longitudinally as the chip passes through the slot thus utilizing the energy normally imparted to the chips. A series of hammers are mounted upon the back face of the disc adjacent to each slot which coact with stationary anvils that are mounted upon the inside of the casing to further break up or pulverize the chips leaving each slot. The chips are then delivered by centrifugal force into a flow channel that surrounds the outer back face and rim of the disc. A series of paddle units are mounted upon the disc with each unit having a wing that passes over the rim of the disc to engage the chip in the flow channel and conducts the chips into a discharge duct. In a further refinement, serrated chip cutters are contained on at least one wall of the flow channel which coact with the wings to further reduce the size of the chips prior to their entering the discharge duct. Here again only the energy normally associated with the chipping operation is utilized in this chip reduction operation. The discharge duct is connected to a separator or chip bin in which the chips are separated from air in the flow stream. A roughened or serrated baffle plate is located at the entrance to the separator or bin upon which the entering chips are impinged to again still further reduce the size of the chips utilizing the kinetic energy stored in the chip stream.

BRIEF DESCRIPTION OF THE DRAWING

For a better understanding of these and other objects of the present invention reference will be made to the following detailed description of the of the invention which is to be read in association with the accompanying drawings, wherein.

DESCRIPTION OF THE INVENTION

Figure 1:
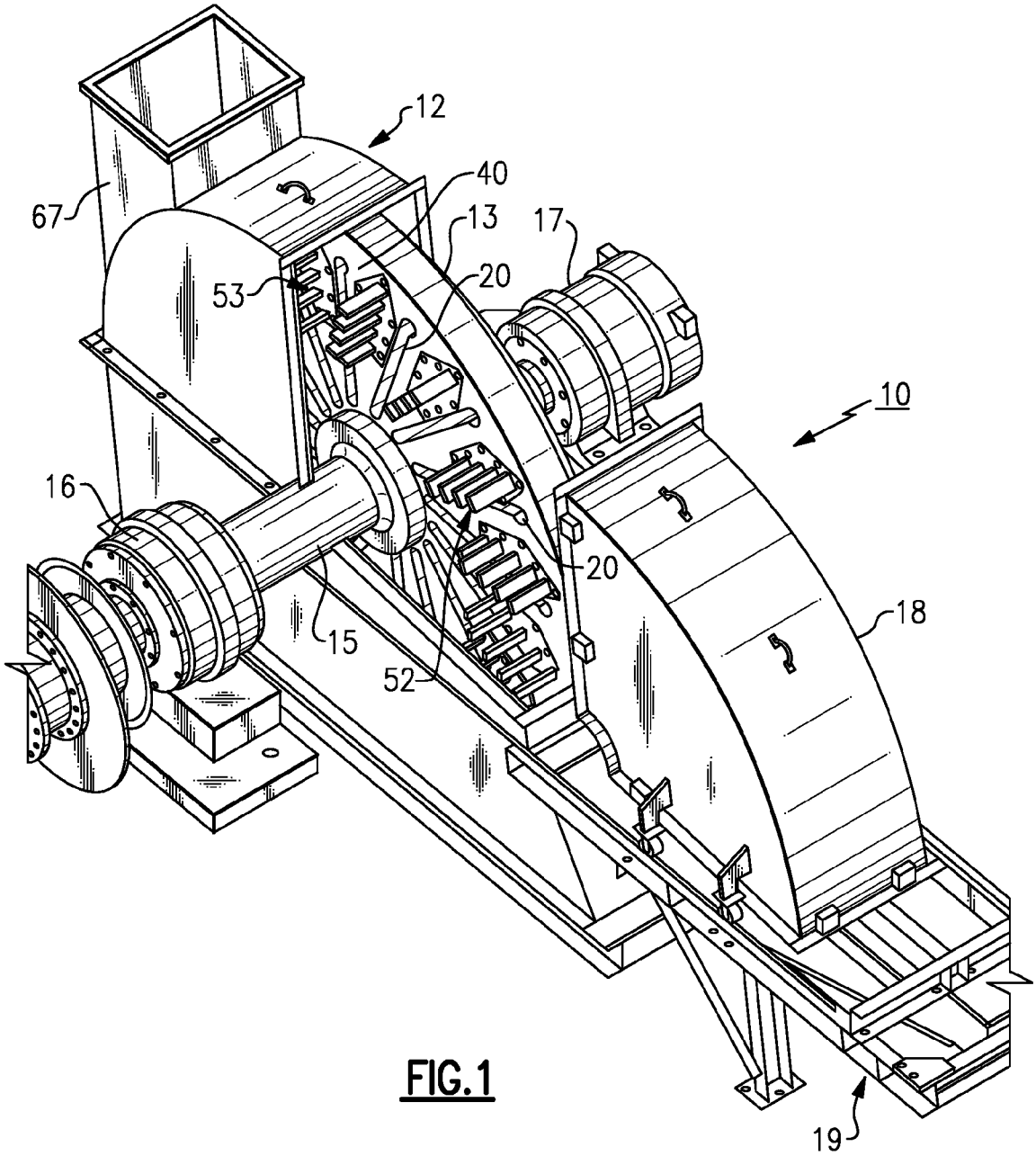
FIG. 1 is a rear perspective view of a wood chipping machine with portions of the machine casing moved back to better illustrate the chipping disc system of the present invention.

Turning initially to FIG. 1 there is illustrated a wood chipping machine, generally referenced 10, that embodies the teachings of the present invention. The machine is enclosed by a heavy metal protective casing generally referenced 12 which encompasses a rotary disc 13. The disc is mounted upon a horizontally disposed shaft 15 that is supported upon a pair of bearing blocks 16 and 17. The shaft is turned at a relatively high rim speed of between 9,000 and 13,000 feet per minute (2,800 and 4,000 meters per minute) by a high speed motor and transmission (not shown). In this view, a quarter section 18 of the casing has been detached from the main section of the casing and moved back along a rail system 19 to expose the back side of the disc. Preferably, the disc has a diameter of about 72" (1.8 meters or more) and contains between 10 and 40 slots 20-20 that extend more or less radially from the mid region of the disc toward the outer rim thereof. Slot angles of between 30 and 45 degrees with regard to the front face of the disc can be employed depending upon the energy demands of the system.

Figure 2:
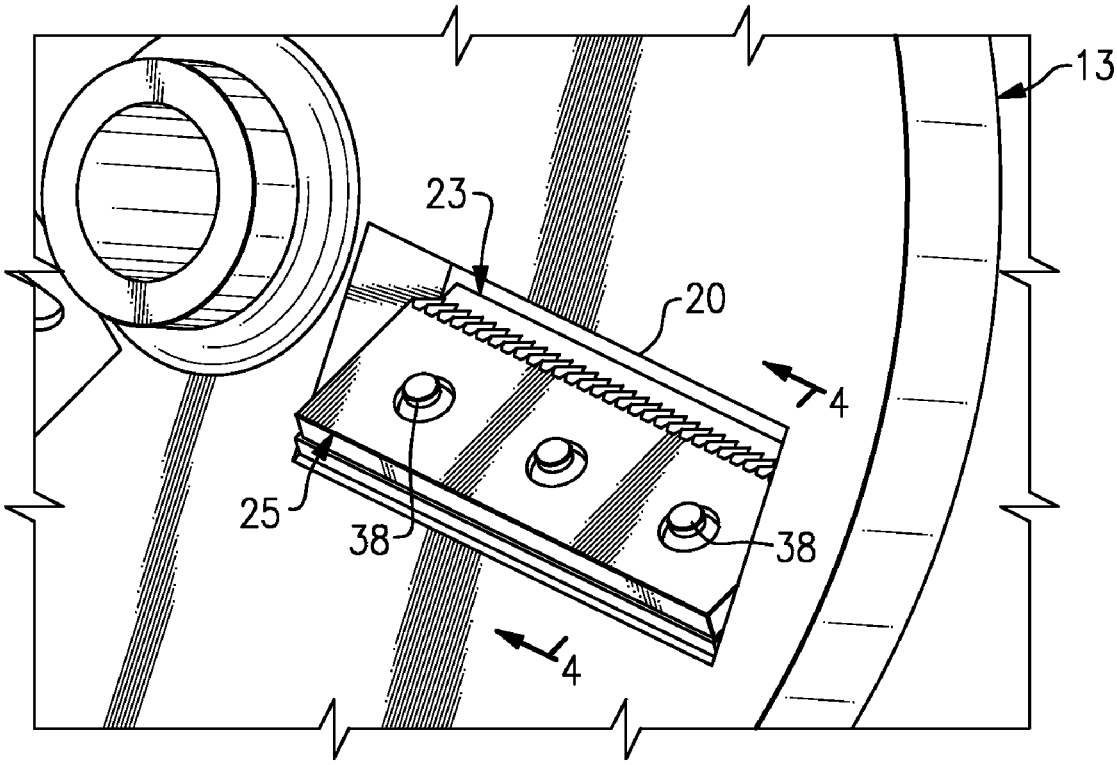
FIG. 2 is a partial perspective view again viewing from the back side of the machine further illustrating the knife alignment contained in the chipper disc slots.
Figure 4:
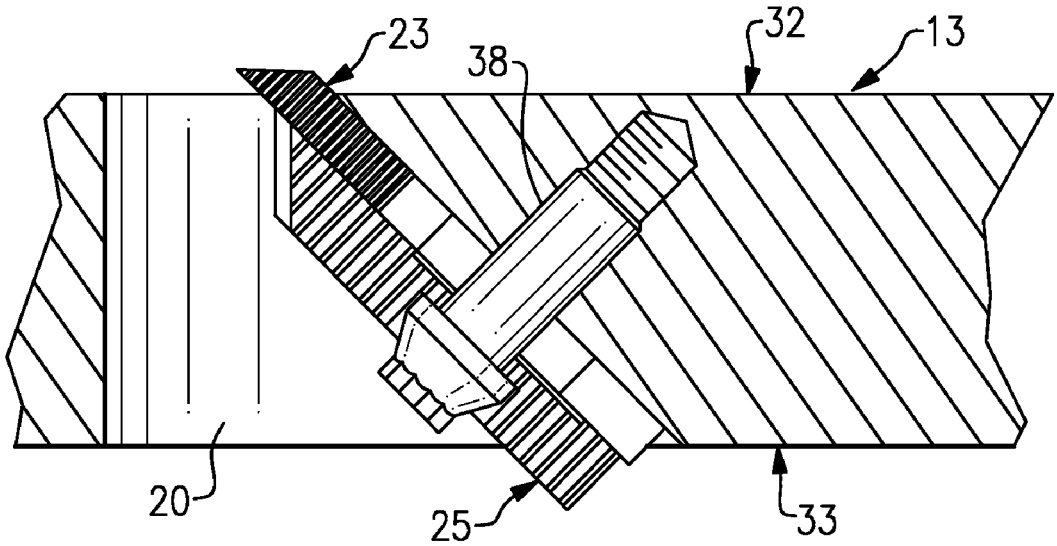
FIG. 4 is an enlarged sectional view that is taken along lines 4-4 in FIG. 2.
Figure 3:
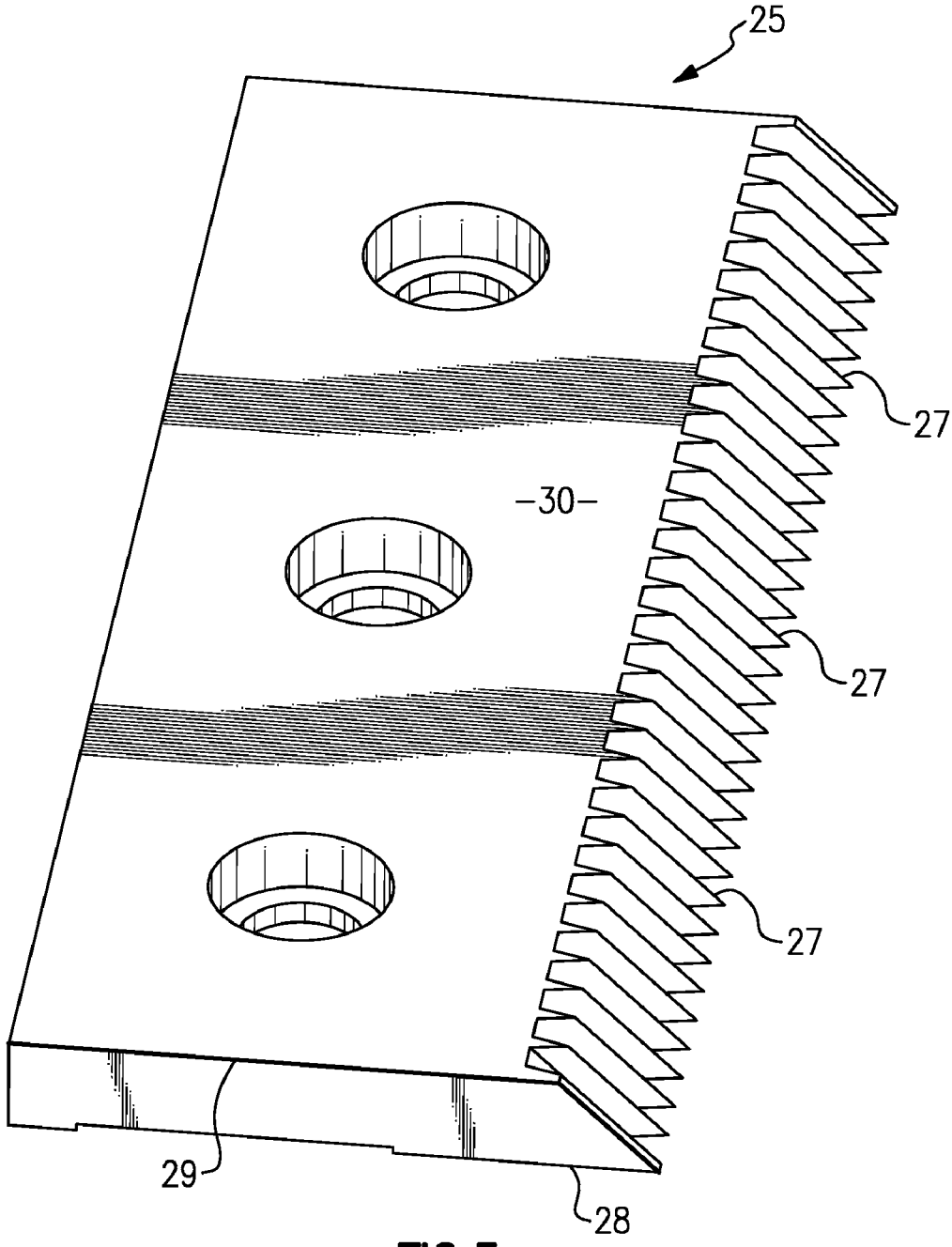
FIG. 3 is an enlarged perspective view of a counter knife blade that is mounted in each of the disc slots behind the chipper's primary blade.

As further illustrated in FIGS. 2-4, each slot 20 contains a primary blade 23 located in the entrance to the slot at the front face of the disc. The primary blade contains a single knife edge and may have one or more sections that extend across the slot opening. The primary knife is arranged to slice chips of a predetermined length from a log or any other similar wooden work piece that is brought into contact with the front face of the disc through a feed spout or throat (not shown). A second counter knife 25 is mounted in each of the slots immediately behind the primary knife. The surface of the counter knife that contacts the chips is serrated and contains a series of parallel blade elements 27-27 that slope upwardly from the back face 28 of the knife toward the front edge face 29 thereof as best shown in FIG. 3. In assembly, the counter knife blades 27-27 are arranged such that they are each aligned perpendicular to the front face 32 and the rear face 33 of the disc. The counter knife blade edges are spaced apart a distance (d) to achieve a product which is substantially smaller than the spacing between the blade edges. The blade edges are positioned to slice each of the chip ribbons coming off the primary blade longitudinally utilizing only the energy normally imparted to the chips but which is not typically used in material size reduction.

As best shown in FIG. 2, the two knives are tightly secured in each of the slots by a plurality of bolts 38-38 that pass through openings provided in each of the knives and are threaded into the disc.

Figure 5:
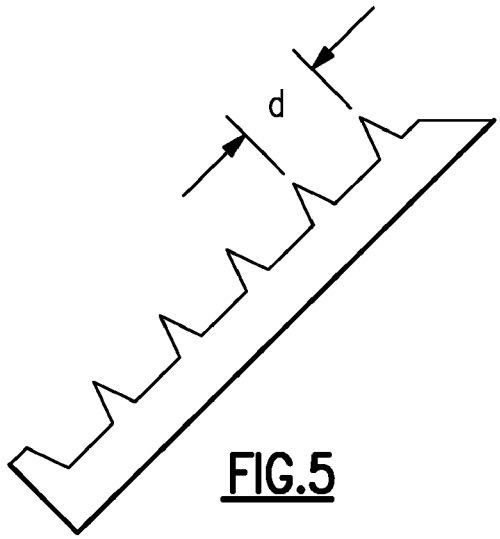
FIG. 5 is a partial enlarged view illustrating the counter knife blade arrangement employed in the main embodiment of the present invention.

This type of knife holder is relatively simple in design, however it provides for ease of positioning of both knifes so that the blades of the counter knife can be properly aligned with the blade of the primary knife while, at the same time enabling the primary blade to be positioned within the slot to produce chips having a desired length that typically is between ¼" and ⅝" (6 and 10 mm). As noted above, as the initially cut chips move through each slot they are cut longitudinally by the blades of the counter knife. As illustrated in FIG. 5, each of the blades on a counter knife may be spaced for example about ⅜ of an inch (10 mm) from its neighbor so that a preponderance of the chips that exit each slot have a width of about ⅜" (10 mm). As illustrated in FIG. 5, the counter knife blades are each of equal height between the blade root and its cutting edge. The height of the blades is selected depending upon the width of the slot in which it is mounted so that the maximum number of chips are acted upon as they pass through the slot. In either case, the spacing between the blades cutting edge is uniform as for example the above noted ⅜" (10 mm).

Figure 7:
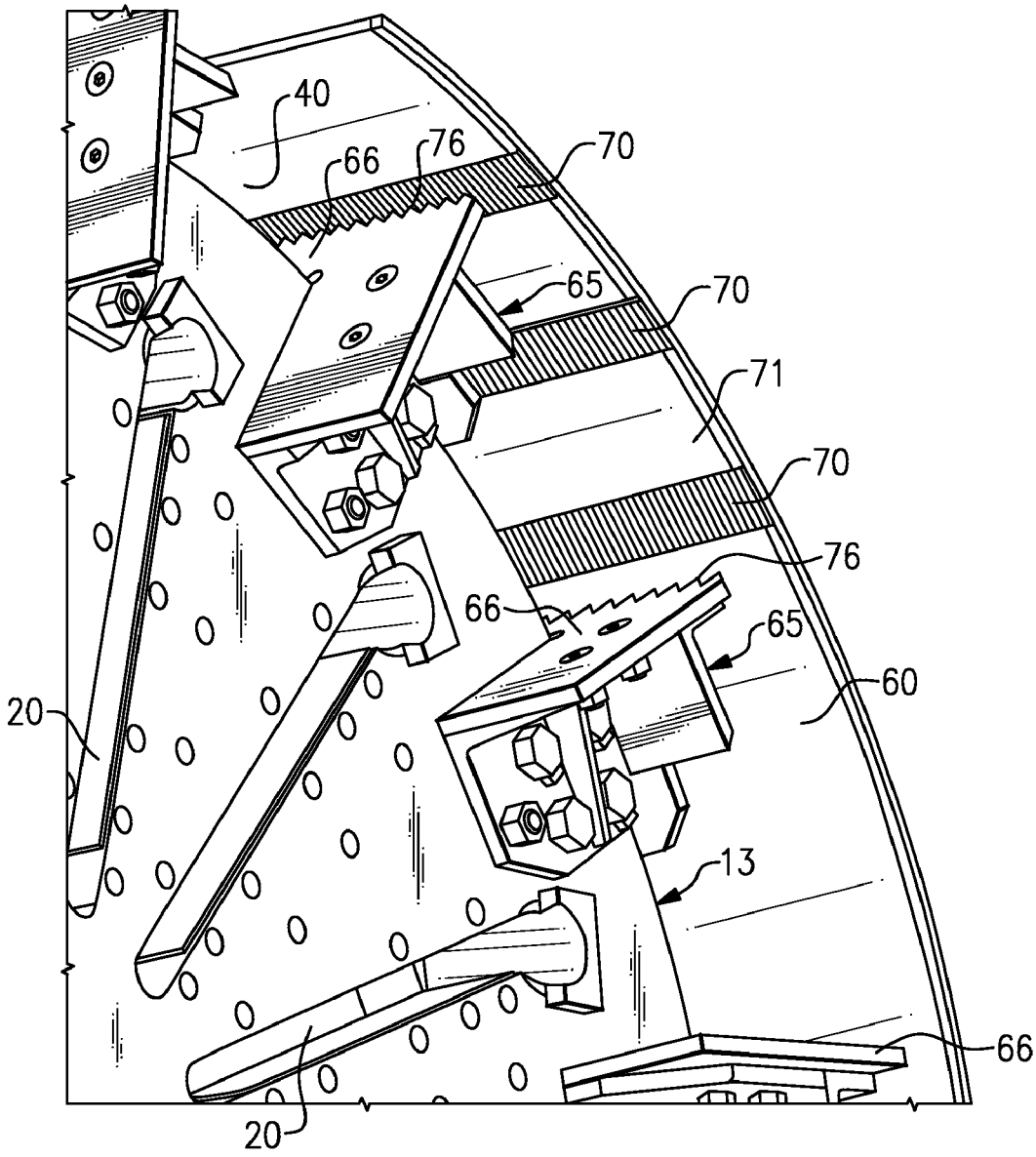
FIG. 7 is a partial enlarged perspective view illustrating a series of paddle units employed in the present chipper system.

Upon leaving each slot, the chips are directed by the centrifugal force generated by the rotating disc toward the rim of the disc and ultimately into a flow channel 40 (FIG. 1) that encompasses the back of the disc. Immediately adjacent to each slot and in general parallel alignment therewith are a plurality of hammer units 52-52 that are secured to the rear face of the disc so that the hammer units rotate with the disc. As best seen in FIG. 7, the hammers are arranged to move through clusters of stationary anvil units 53-53 that are mounted upon the inside rear wall 55 of the machine casing within the flow channel. The hammers mounted upon the disc are adapted to pass through spaces provided in the anvil clusters to tear, shard, or otherwise pulverize the chips as they move toward the rim of the disc within the flow channel.

Figure 8:
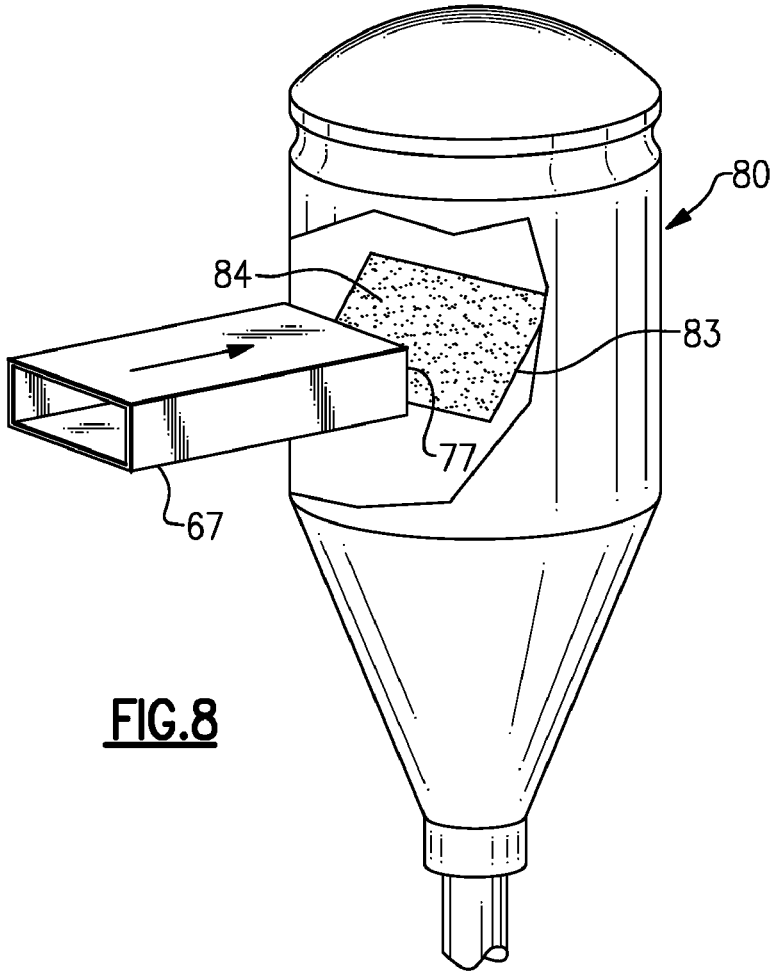
FIG. 8 is a perspective view illustrating a top discharge duct of the present machine delivering chips into a chip bin or separator.
Figure 6:
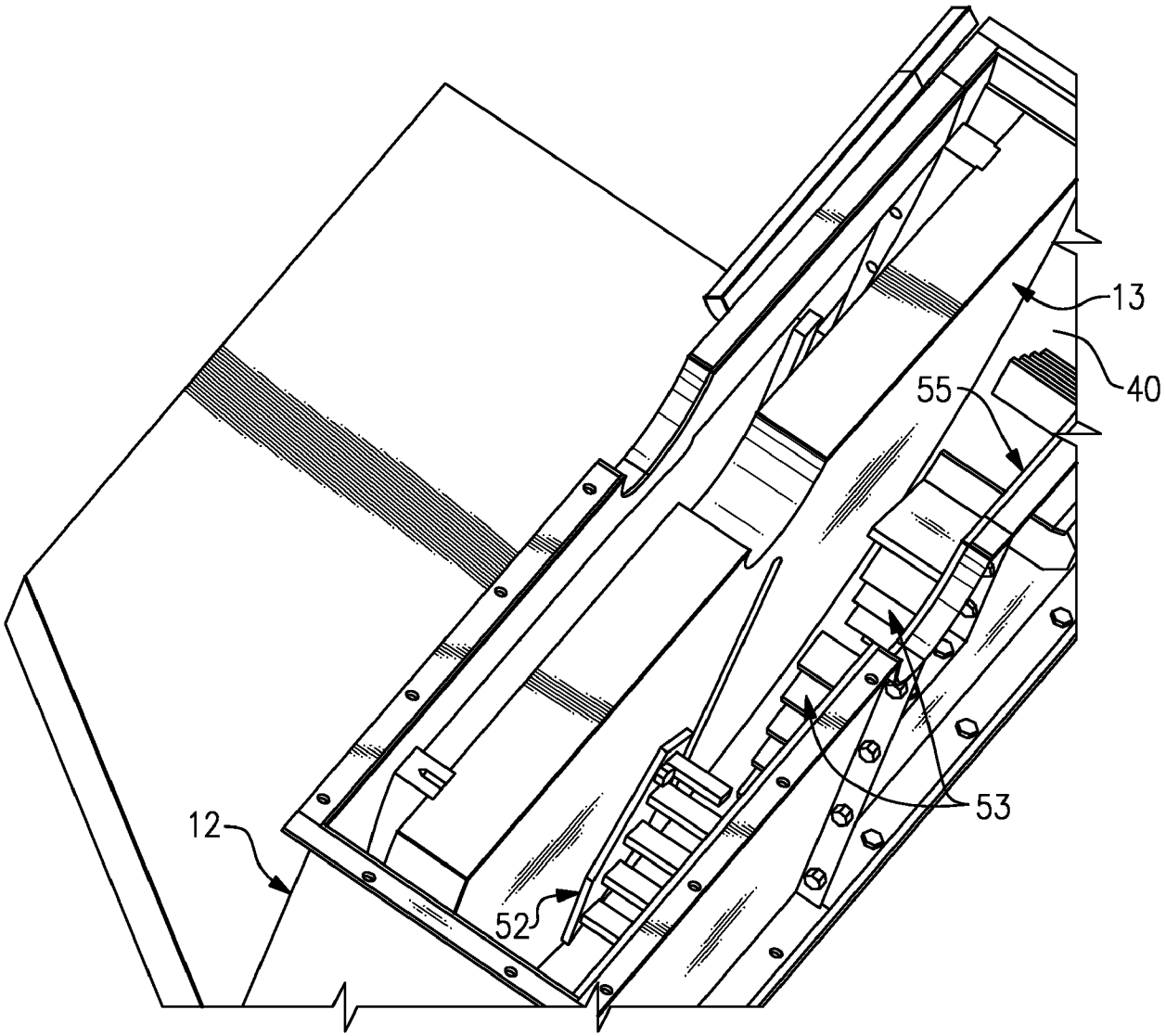
FIG. 6 is a partial enlarged perspective view showing a hammer and anvil mounting arrangement suitable for use in the present chipper.

After the hammering operation is completed, the chips move upwardly in the flow channel into the rim area of the rotating disc. As illustrated in FIG. 8 the top wall 60 of the chute as well as the side wall of the chute are formed by the outer part of the machine casing. A series of paddle assemblies, generally referenced 65, are bolted to the back face of the disc between some or each of the slots. Each of the paddle assemblies contains an elongated blade 66 that passes over the rim of the disc with the blade substantially filling the top of the chamber 40 so that the blades engage and propel the chips within the chamber into the entrance to discharge chute 67 shown in FIG. 1.

A close running clearance can be provided between the edges of the blades and the walls of the chamber. A number of serrated sections 70-70 are contained on the inner surface 71 of the top wall of the flow chamber. The serrated sections extend across the entire width of the paddle blades whereby the chips are forced by the rotating disc into contact with the serrations as the paddle blades move thereunder. Here again, due to forces involved and the speed of the disc, the average chip size is further reduced within the chamber before the flow is released to the discharge duct. The upper edge of the paddle blades can also contain serrations 76 to further enhance the effectiveness of the chip reducing process.

Figure 9:
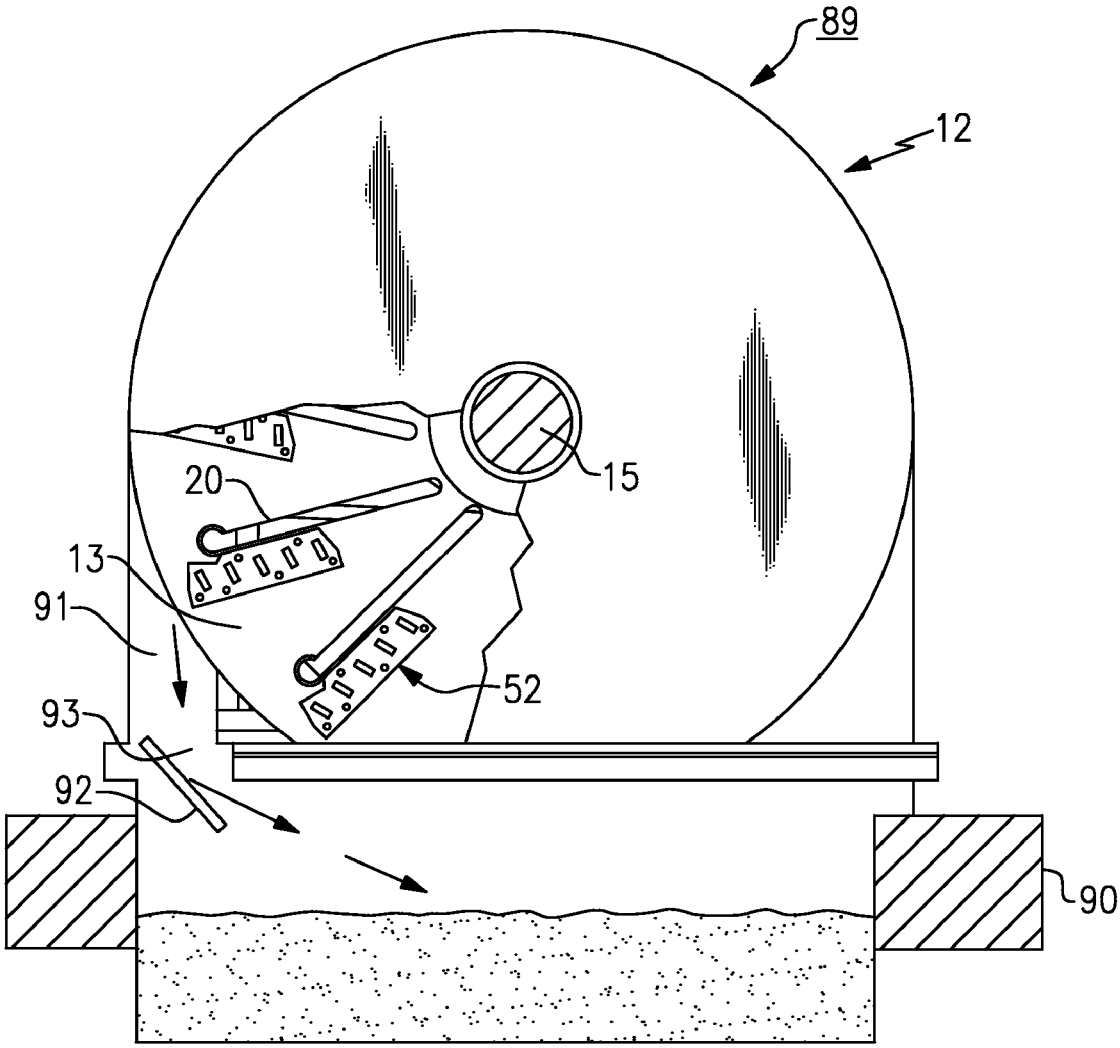
FIG. 9 is a side elevation showing a chipper having a bottom discharge that employs the chip reducing system of the present invention.

As noted above, the disc rim speed of the machine is preferably between 9,200 and 13,000 feet per minute. Accordingly, the chips entering the duct are moving at or slightly below the rim velocity of the disc. A good deal of kinetic energy is thus contained in the exiting flow stream. As shown in FIG. 9, the discharge duct in this embodiment is connected to a cyclone separator 80 or any other similar device for separating the chip material from the entering air. The discharge end 77 of the duct is arranged to empty into the separator so that the flow is directed onto the inclined receiving surface 84 of baffle plate 83. The plate has a roughened or serrated impact surface, against which the still rapidly moving chips are directed causing a still further reduction in the average chip size.

Turning now to FIG. 10, there is shown a wood chipper generally referenced 89 that embodies the teachings of the present invention and which is equipped with a chip handling system having a downward discharge configuration. The chipper is mounted upon a substrate such as a cement floor 90 over a chip collecting bin 94. A downwardly directed discharge duct 91 connects the chip flow channel located at the rear of the disc 13 to the collecting bin. An inclined baffle plate 92 is mounted within the entrance 93 of the bin so that the baffle intercepts the incoming flow stream as it is discharged into the bin. Here again, the impacted surface of the baffle plate is roughened or serrated sufficiently to further pulverize or reduce the size of the incoming chips.

As should be now evident, the chips produced in the present machine undergo a multi-step reduction in size as they move through the machine. Two of the steps involve the slicing of chips from a wooden work piece while the following steps involve further physically breaking down or pulverizing the chips. These steps are all carried out utilizing the energy already supplied to a chipper for chipping but not normally utilized for significant material size reduction by the machine to produce chips of a size such that the chips can pass freely through a sieve having ⅜" (10 mm) diameter holes. Accordingly, the chips so produced can be more efficiently and rapidly turned into the extremely small sizes necessary in the production of wood pellets or for use in various chemical or industrial processes.

While the invention has been described with reference to a preferred embodiment, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. A disc type chipper that includes a rotatable disc having a circular outer rim and that includes a series of spaced apart radial disposed slots having an entrance at a front face of said disc and an exit at a rear face of said disc;

a drive means for rotating said disc at a desired velocity;

a casing for housing said disc, said casing establishing a flow channel about said rear face of said disc and its circular outer rim;

a primary knife that is mounted at the front entrance of each of said slots for cutting chips from a work piece when said work piece is brought into contact with said front face of said rotating disc whereby said chips are moved by centrifugal force through each of said slots into said flow channel;

a counter knife mounted proximate to each said primary knife for slicing said chips as said chips leave said primary knife;

a series of hammer units that are rigidly mounted upon said rear face of said disc between said slots, said hammer units being positioned to co-act with a series of anvils mounted on an inner wall of said casing for reducing the size of said chips moving in said flow channel; and a series of paddle blades that are secured to said disc, each paddle blade including a surface that passes over the outer rim of said disc and that substantially extends through said flow channel to engage chips that are being driven through said flow channel to direct said chips into an exhaust duct or directly into a bin.

2. The chipper of claim 1 wherein said exhaust duct contains an exit through which chips are discharged into a chip collecting means for storing said chips.

3. The chipper of claim 2 wherein said chip collecting means is a separator for separating air from the said chips.

4. The chipper of claim 2 wherein said chip collecting means is a storage bin.

5. The chipper of claim 2 that further includes an inclined baffle plate mounted adjacent to said duct exit for intercepting said chips that are moving through said exit to further reduce the size of chips in the discharged flow.

6. The chipper of claim 5 wherein said baffle plate contains a roughened or serrated chip contact surface.

7. The chipper of claim 1 wherein each of said counter knives contains a series of parallel spaced apart blades each having a cutting edge that extend longitudinally along said containing slot between said slot entrance and said slot exit.

8. The chipper of claim 7 wherein said cutting edges of said counter knife blades are spaced apart a distance of about ¼ to ⅝ of an inch.

9. The chipper of claim 7 wherein each counter knife blade edge slopes downwardly from said entrance of said slot toward its exit.

10. The chipper of claim 9 wherein each counter knife blade in said series has a height from its root to its cutting edge that is equal to that of its neighbor.

11. The chipper of claim 1 wherein each paddle blade contains serrated edges which coact with serrated elements mounted upon said casing to further reduce the chip size in said flow channel.

12. The chipper of claim 1 wherein said drive means rotates said disc at a rim velocity of between 9,000 and 13,000 feet/min.

13. The chipper of claim 12 wherein said disc has a diameter of at least 72 in.

14. The chipper of claim 12 wherein said disc contains between 4 and 40 slots.

15. The chipper of claim 1 that further includes a series of serrated elements that are disposed from said casing and that co-act with said paddle blades to still further reduce the size of said chips as said chips are conducted toward said exhaust duct.

* * * * *